United States Patent [19]

Brückner et al.

[11] Patent Number: 4,984,769

[45] Date of Patent: Jan. 15, 1991

[54] TAP SPOUT FOR METALLURGICAL VESSELS AND METHOD OF REPAIRING

[75] Inventors: Raimund Brückner, Engenhahn-Niedernhausen; Axel Eschner, Göllheim; Wilhelm Langenfeld, Düsseldorf; Manfred Oberbach, Krefeld; Hans Rothfuss, Taunusstein; Dieter Stüsser, Duisburg, all of Fed. Rep. of Germany

[73] Assignee: Didier-Werke AG, Wiesbaden, Fed. Rep. of Germany

[21] Appl. No.: 457,168

[22] Filed: Dec. 26, 1989

[30] Foreign Application Priority Data

Dec. 23, 1988 [DE] Fed. Rep. of Germany ..... 3843545

[51] Int. Cl.[5] ..... F27D 1/16

[52] U.S. Cl. ..... 266/44; 266/45; 266/195; 266/236; 266/272; 266/281; 264/30; 222/604

[58] Field of Search ..... 266/44, 45, 281, 236, 266/240, 271, 272, 273, 195; 222/604; 264/30

[56] References Cited

U.S. PATENT DOCUMENTS 3,463,475 8/1969 Buchholz ..... 266/236
4,427,184 1/1984 Steinwider et al. ..... 266/271

FOREIGN PATENT DOCUMENTS 326164 1/1974 Austria .
3511341 10/1986 Fed. Rep. of Germany ..... 266/236

*Primary Examiner*—Melvyn J. Andrews
*Attorney, Agent, or Firm*—Wenderoth, Lind & Ponack

[57] ABSTRACT

A tap spout, particularly for allowing molten metal to be discharged from oxygen-steel converters, includes a replaceable unit including a tubular wear lining and a jointing layer secured thereto. An inner lining of the tap spout may thus be repaired with relatively simple maintenance work by removing the inner lining and subsequently inserting the replaceable unit into an outer lining of the tap spout to form a new inner lining of the tap spout. The replaceable unit is adapted to facilitate either a press fit, and in particular, a fit ensured by axial compression of the jointing layer, or an expansion fit with the outer lining to secure the replaceable unit therein.

21 Claims, 1 Drawing Sheet

FIG. 1
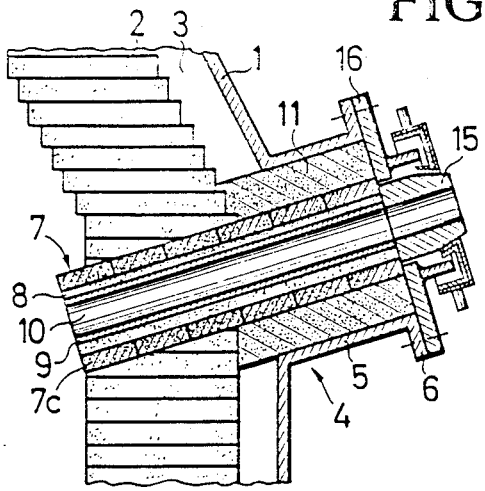
FIG. 2
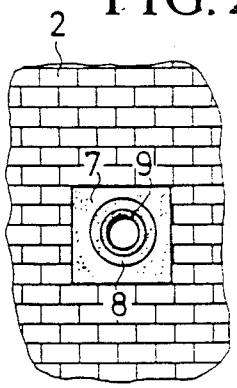
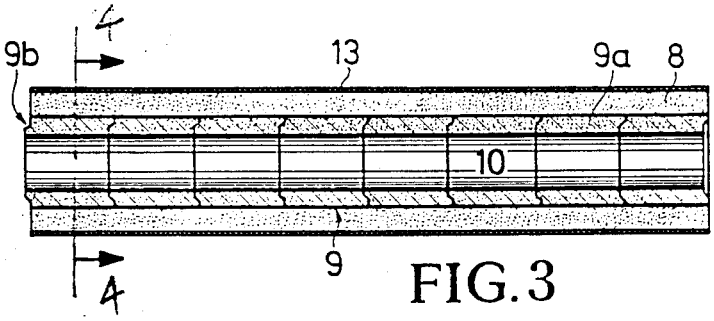
FIG. 3
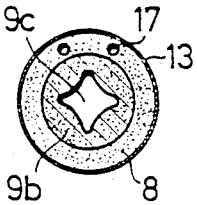
FIG. 4
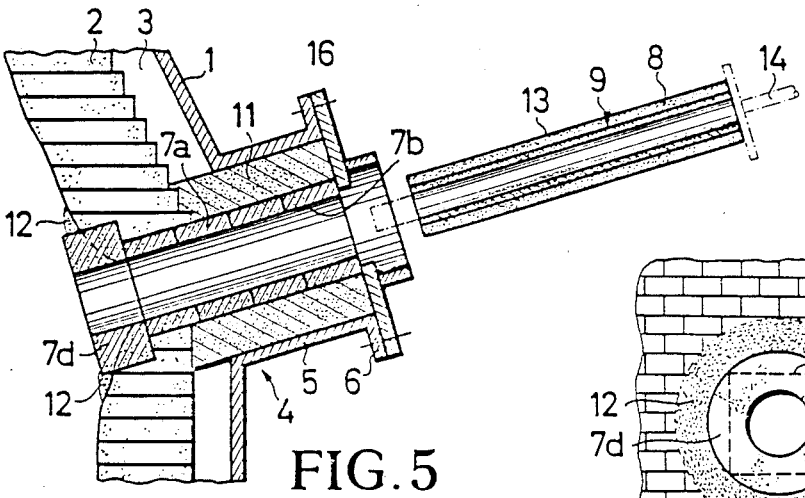
FIG. 5
FIG. 6
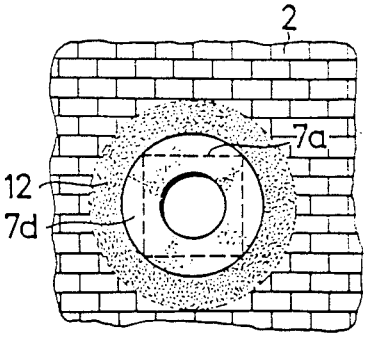

TAP SPOUT FOR METALLURGICAL VESSELS AND METHOD OF REPAIRING

BACKGROUND OF THE INVENTION

The invention relates to a tap spout for metallurgical vessels, particularly for oxygen-steel converters which may be tilted about a rotary axis, comprising a refractory permanent lining incorporated in the refractory brickwork of the vessel and a refractory, replaceable, tubular wear lining mounted therein by means of a refractory jointing layer.

During a period of delivery from metallurgical vessels, particularly a converter run, it is essentially attempted for reasons of efficiency to maintain the maintenance expense on the converter as small as possible. The converter tap spout requires regular maintenance, principally in order to ensure a dense poured stream during the tapping period and in order to avoid slag from also flowing out of the converter if a significant crater should form at the inlet end of the tap spout. This requires a tap spout which is always intact, which can only be permitted to become worn within certain limits and which thus must be renewed within the life of the converter many times as part of a hot blast repair.

AT-A-326164 discloses a metallurgical vessel with a tap spout which has perforated blocks which are firmly inserted into the vessel brickwork behind one another as a permanent lining and in whose bore there are mounted wear tubes serving as a wear lining. These wear tubes are fixed in position by the pouring or the ramming of a refractory composition into the gap between the wear tubes and the permanent lining.

SUMMARY OF THE INVENTION

It is the object of the present invention to provide an improved tap spout which requires relatively simple maintenance as compared to prior art tap spouts.

To achieve this object, the tubular wear lining and the jointing layer surrounding it are a replaceable unit which may be inserted into the permanent lining. Such a preassembled replaceable unit may be easily and rapidly positioned in the passage in the permanent lining, which has been cleaned of wear residues, with comparatively little labor-intensive expense so that a lengthy, separate application of, for instance, a spraying, pouring or stamping composition, for fixing the wear lining in position is unnecessary.

A jointing layer, which is radially compressed after the insertion of the replaceable unit, can conveniently be provided in the permanent lining of the tap spout. The jointing layer may be applied to the wear lining with an outer tolerance with respect to the permanent lining which renders a simple press-fit of the replaceable unit in the tap spout, and in particular, the tolerance can ensure an operationally reliable fit of the replacement unit in the permanent lining upon a secondary axial compression of the jointing layer. Alternatively, a jointing layer may also advantageously be used which comprises refractory material which expands under the action of heat so that a tolerance of the jointing layer with respect to the permanent lining, which is present before the insertion of the replaceable unit, is taken up under increasing operational temperature and a sealed, firm fit of the replaceable unit is automatically achieved. Both jointing layers can, for instance, be brushed or otherwise spread onto the wear lining in the form of a refractory composition or wound onto a strip of paper so as to adhere to it. A composition mixed with a blowing agent serves as the expanding material. It is in all cases advantageous to provide the jointing layer with gas passages extending in the longitudinal direction of the replaceable unit in order to allow gas to flow therethrough and force back slag in the flow region of the tap spout. Such gas passages can be easily produced, for instance, by inserting into the jointing layer cords which can be burnt away.

It is also an object of the invention to provide the jointing layer on a wear lining which is unitarily constructed as a tube so as to realize a simple and thus easily fabricatable replaceable unit. The replaceable unit further advantageously has, at least at its inner end, a wear lining section with a restricted, for instance, square-shaped, cross section. The molten metal thus flows through the tap spout relatively smoothly without intensified eddy formation which in turn prevents a crater from being prematurely formed by erosion at the inlet of the tap spout and thereby obviates the undesirable outflow of slag together with the molten metal which is known to occur when such a crater is in fact formed. Finally, to increase the service life, in accordance with the invention, the tap spout may be provided with a replaceable outlet spout at the outer end of the replaceable unit.

BRIEF DESCRIPTION OF THE DRAWINGS

The invention is described below with reference to the drawings, in which:

FIG. 1 is a longitudinal sectional view of a tap spout region of a converter according to the present invention;

FIG. 2 is a view of the tap spout region of FIG. 1 as taken from the interior of the converter;

FIG. 3 is a longitudinal sectional view of a replaceable unit in the tap spout of FIG. 1 according to the present invention;

FIG. 4 is a cross-sectional view taken along line 4—4 in FIG. 3;

FIG. 5 is a view similar to that of FIG. 1 showing a repair state; and

FIG. 6 is a view of the tap spout region of FIG. 5 as taken from the interior of the converter.

DETAILED DESCRIPTION OF THE PREFERRED EMBODIMENT

The converter, whose tap spout region is shown, has a sheet metal shell 1 and a refractory lining comprising brickwork 2 which becomes worn and a backing 3. The tap spout 4 is fixed in position within a sleeve 5 of the sheet metal shell which terminates at an external connecting flange 6. The core of the tap spout 4 is a refractory fitting comprising an outer permanent lining 7, a jointing layer 8 and a tubular inner wear lining 9 which surrounds the tap hole 10. When the converter is relined, the fitting 7 to 10 is inserted preassembled into the lining 2, 3, coaxially with the sleeve 5 and is there embedded in a refractory lining 11.

The permanent lining 7, which comprises a plurality of safety blocks *7a*, affords a reliable connection with the converter brickwork 2 and remains a component of the refractory linings 2, 3 and 11 until the next relining of the converter. On the other hand, when the wear lining 9 is in a state of advanced wear down to the jointing layer 8 and when the tap spout inlet is eroded into a crater shape (indicated in chain lines in FIG. 5)

repairs to such locations are basically repeated as necessary. This involves so-called hot repairs which are to be effected as rapidly as possible with the converter in an uncooled state. Firstly, remaining fragments of the jointing layer 8 and the wear lining 9 are cleared away, for instance drilled or forced out from the exterior, so that, as may be best be seen in FIG. 5, the round passage 7b in the permanent lining 7 is exposed. Then, if it is worn into a crater shape, the inner safety block 7c (FIG. 1) is replaced by an annular replacement safety block 7d fixed in position with a refractory composition 12 (FIG. 5). On the other hand, the safety block 7c can remain in position if visual judgement suggests that its durability is such that it can withstand the time interval until the next repair.

After these preparations, the replacement of the wear lining 9 is effected by inserting a prepared replaceable unit, comprising jointing layer 8 and wear lining 9 and also a jacket 13, in the round passage 7b in the permanent lining 7 with a single operation, preferably with the aid of a handling tool 14 operated by a lifting appliance. As shown in FIGS. 3 and 4, the wear lining 9 of the replaceable unit 8, 9, 13 comprises wear tubes 9a forming a row in which the tubes 9a are aligned by tongue and groove connections, or a unitary wear tube (FIG. 5) and is surrounded by a moldable jointing layer 8. The jointing layer 8 is retained by a jacket 13 in such a manner that the unit 8, 9, 13 is press-fit without difficulty into the permanent lining 7 and, in particular, the unit 8, 9, 13 can be fixed in position in the permanent layer by facilitating a secondary axial compression of the jointing layer 8. On the other hand, the jointing layer 8 can comprise a compound or mortar material, for example vermiculite-containing materials and inflated graphite, which expands or swells under the action of heat and which ensures a firm expansion fit of the replaceable unit 8, 9, 13 at the operational temperature of the converter. After installation of the replaceable unit 8, 9, 13, any crater still present around the replaceable unit 8, 9, 13 in the inner surface of the brickwork 2 and in the permanent lining 2 is filled with a hot repair compound. When using wear tubes 9a assembled in a row these are conveniently held clamped under stress on the handling tool 14 during their handling.

In a modification of the round cross section of the passage of the wear tubes 9a, the inlet wear tube 9b can have a diamond-shaped cross section, a slit-shaped cross section or other restricted flow cross section 9c which inhibits the formation of eddies in the molten metal flowing into the tap hole 10 to prevent the crater-shaped erosion of the hole inlet. A similar preventive effect against premature erosion at the end of the tap hole 10 by molten metal flowing out when the converter is tilted is achieved by the replaceable outlet spout 15 which is replaceably secured to a removable connecting plate 16 of the connecting flange 6 and, if necessary, can be replaced by a blind plug.

In a further embodiment of the replaceable unit 8, 9, 13, the jointing layer 8 has gas passages 17 (FIG. 4) extending parallel to the tap hole 10, through which, if necessary, gas is supplied to the molten metal inlet end in order to blow away any slag flowing with the molten metal. If the jointing layer is, for instance, brushed or otherwise spread on, it is advisable to retain it in position on the wear lining with the jacket 13. A flexible jacket, which can have perforations and/or reinforcements, should particularly be used.

The invention has been described above with respect to preferred embodiments thereof. However, various changes and modifications will become apparent to those of ordinary skill in the art. Such changes and modifications are seen to fall within the true scope of the invention as defined by the appended claims.

What is claimed is:

1. A method of repairing a tap spout of a metallurgical vessel for allowing molten metal to be discharged from the vessel, and which tap spout has an outer permanent lining fixed in the vessel, an inner lining and a jointing layer securing the inner lining to and within said outer permanent lining, said method comprising:

removing the inner lining and the jointing layer when worn;

providing a replacement unit comprising a tubular inner wear lining and a jointing layer secured to and surrounding said tubular inner wear lining, having a tolerance and/or characteristics that will facilitate insertion of the replacement unit within said outer permanent lining yet cause the replacement unit to be compressed therein; and inserting the replacement unit into the outer permanent lining, after the step of removing, to secure the replacement unit under compression to and within the outer permanent lining.

2. A method of repairing a tap spout as claimed in claim 1, wherein the step of providing comprises providing a replacement unit having a tolerance which facilitates a press-fit thereof within the outer permanent lining, and the step of insertion comprises forcing the replacement unit into the outer permanent lining to secure the replacement unit under a press-fit to the outer permanent lining.

3. A method of repairing a tap spout as claimed in claim 2, wherein the step of providing comprises providing a replacement unit in which the jointing layer thereof comprises material which expands under heat to a degree sufficient to establish an expansion fit of the replacement unit to the outer permanent lining when the replacement unit is inserted within the outer permanent lining and is heated by the molten metal to be discharged through the tap spout from the metallurgical vessel.

4. A metallurgical vessel comprising a lining of refractory brickwork, and a tap spout mounted in the vessel for allowing molten metal to be discharged from the vessel, said tap spout comprising an outer permanent lining fixed to said brickwork, and a replaceable unit axially compressed within said outer permanent lining, said replaceable unit including a tubular inner wear lining and a jointing layer secured to and said surrounding said tubular inner wear lining.

5. A metallurgical vessel comprising a lining of refractory brickwork, and a tap spout mounted in the vessel for allowing molten metal to be discharged from the vessel, said tap spout comprising an outer permanent lining fixed to said brickwork, and a replaceable unit compressed within said outer permanent lining, said replaceable unit including a tubular inner wear lining and a jointing layer secured to and said surrounding said tubular inner wear lining, said jointing layer comprising refractory material that expands when subjected to heat, and said replaceable unit being expansion-fit via the expansion of said jointing layer within said outer permanent lining.

6. A metallurgical vessel comprising a lining of refractory brickwork, and a tap spout mounted in the vessel for allowing molten metal to be discharged from the vessel, said tap spout comprising an outer permanent lining fixed to said brickwork, and a replaceable unit compressed within said outer permanent lining, said replaceable unit including a tubular inner wear lining and a jointing layer secured to and said surrounding said tubular inner wear lining, said jointing layer having passageways extending therein longitudinally of said tubular inner wear lining.

7. A metallurgical vessel comprising a lining of refractory brickwork, and a tap spout mounted in the vessel for allowing molten metal to be discharged from the vessel, said tap spout comprising an outer permanent lining fixed to said brickwork, and a replaceable unit compressed within said outer permanent lining, said replaceable unit including a tubular inner wear lining, a jointing layer secured to and said surrounding said tubular inner wear lining, and a jacket surrounding said jointing layer and securing said jointing layer on said tubular inner wear lining.

8. A metallurgical vessel as claimed in claim 7, wherein said jacket comprises flexible material.

9. A metallurgical vessel comprising a lining of refractory brickwork, and a tap spout mounted in the vessel for allowing molten metal to be discharged from the vessel, said tap spout comprising an outer permanent lining fixed to said brickwork, and a replaceable unit compressed within said outer permanent lining, said replaceable unit including a tubular inner wear lining in the form of a one-piece pipe and a jointing layer secured to and surrounding said one-piece pipe.

10. A metallurgical vessel comprising a lining of refractory brickwork, and a tap spout mounted in the vessel for allowing molten metal to be discharged from the vessel, said tap spout comprising an outer permanent lining fixed to said brickwork, and a replaceable unit compressed within said outer permanent lining, said replaceable unit including a tubular inner wear comprising a plurality of axially aligned wear tubes and a jointing layer secured to and surrounding the wear tubes of said tubular inner wear lining.

11. A metallurgical vessel as claimed in claim 10, wherein each of said wear tubes has opposite ends defining a tongue and groove, and said wear tubes are seated in axial alignment with one another by a said tongue and groove at confronting ends of each adjacent pair of said wear tubes.

12. A metallurgical vessel as claimed in claim 30, wherein one of said wear tubes, located at an end of said inner wear lining within the vessel, defines an axial opening therethrough having a cross-sectional area that is less than the cross-sectional area of openings defined through others of said wear tubes so as to restrict the flow of molten metal through said tap spout at the end of said inner wear lining.

13. A metallurgical vessel comprising a lining of refractory brickwork, a tap spout mounted in the vessel for allowing molten metal to be discharged from the vessel, said tap spout comprising an outer permanent lining fixed to said brickwork and a replaceable unit compressed within said outer permanent lining, said replaceable unit including a tubular inner wear lining and a jointing layer secured to and surrounding said tubular inner wear lining, and a replaceable spout disposed on an end of said replaceable unit located outside the vessel.

14. A replacement unit for forming the interior lining of a tap spout for allowing molten metal to be discharged from a metallurgical vessel, said replacement unit comprising a tubular inner wear lining and a jointing layer secured to and surrounding said tubular inner wear lining, said tubular inner wear lining and said jointing layer secured thereto being insertable as a unit into an outer lining of a tap spout of a metallurgical vessel, and said jointing layer comprising refractory material that expands when subjected to heat.

15. A replacement unit for forming the interior lining of a tap spout for allowing molten metal to be discharged from a metallurgical vessel, said replacement unit comprising a tubular inner wear lining and a jointing layer secured to and surrounding said tubular inner wear lining, said tubular inner wear lining and said jointing layer secured thereto being insertable as a unit into an outer lining of a tap spout of a metallurgical vessel, and said jointing layer having passageways extending therein longitudinally of said tubular wear lining.

16. A replacement unit for forming the interior lining of a tap spout for allowing molten metal to be discharged from a metallurgical vessel, said replacement unit comprising a tubular inner wear lining, a jointing layer secured to and surrounding said tubular inner wear lining, and a jacket surrounding said jointing layer and securing said jointing layer on said tubular inner wear lining, said tubular inner wear lining, said jointing layer secured thereto and said jacket being insertable as a unit into an outer lining of a tap spout of a metallurgical vessel.

17. A replacement unit as claimed in claim 16, wherein said jacket comprises flexible material.

18. A replacement unit for forming the interior lining of a tap spout for allowing molten metal to be discharged from a metallurgical vessel, said replacement unit comprising a tubular inner wear lining in the form of a one-piece pipe and a jointing layer secured to and surrounding said one-piece pipe, said one-piece pipe and said jointing layer secured thereto being insertable as a unit into an outer lining of a tap spout of a metallurgical vessel.

19. A replacement unit for forming the interior lining of a tap spout for allowing molten metal to be discharged from a metallurgical vessel, said replacement unit comprising a tubular inner wear lining comprising a plurality of axially aligned wear tubes and a jointing layer secured to and surrounding said wear tubes, the wear tubes of said tubular inner wear lining and said jointing layer secured thereto being insertable as a unit into an outer lining of a tap spout of a metallurgical vessel.

20. A replacement unit as claimed in claim 19, wherein each of said wear tubes has opposite ends defining a tongue and groove, and said wear tubes are seated in axial alignment with one another by a said tongue and groove at confronting ends of each adjacent pair of said wear tubes.

21. A replaceable unit as claimed in claim 19, wherein one of said wear tubes, located at one end of said inner wear lining, defines an axial opening therethrough having a cross-sectional area that is less than the cross-sectional area of openings defined through others of said wear tubes.

* * * * *